United States Patent [19]

Mittag

[11] 4,113,110

[45] Sep. 12, 1978

[54] PALLET RACK AND POST PROTECTOR ASSEMBLY

[75] Inventor: Douglas C. Mittag, Bolingbrook, Ill.

[73] Assignee: Aurora Equipment Company, Aurora, Ill.

[21] Appl. No.: 782,185

[22] Filed: Mar. 28, 1977

[51] Int. Cl.[2] ..... A47B 45/00; A47F 5/00; A47B 95/00

[52] U.S. Cl. ..... 211/191; 52/244; 52/288; 211/183; 211/193; 248/345.1

[58] Field of Search ..... 211/183, 190, 191, 192, 211/193; 248/219.1, 219.3, 222.4, 345.1; 52/244, 277, 287, 288, 717, 728, 256, 257

[56] References Cited

U.S. PATENT DOCUMENTS

| | | | |
|---|---|---|---|
| 1,679,117 | 7/1928 | Dye | 248/345.1 |
| 3,303,937 | 2/1967 | McConnell | 211/192 |
| 3,372,552 | 3/1968 | Liddell | 52/728 X |
| 3,559,356 | 2/1971 | Koral | 248/345.1 X |
| 3,626,487 | 12/1971 | Seiz | 211/192 |
| 3,681,885 | 8/1972 | Goggins | 52/288 |
| 3,712,003 | 1/1973 | Hallock et al. | 248/345.1 X |
| 3,717,968 | 2/1973 | Olsen et al. | 52/288 |
| 4,012,878 | 3/1977 | Ellingson | 248/345.1 X |

FOREIGN PATENT DOCUMENTS

| | | | |
|---|---|---|---|
| 748,273 | 12/1966 | Canada | 211/191 |

*Primary Examiner*—Thomas J. Holko
*Attorney, Agent, or Firm*—Hill, Gross, Simpson, Van Santen, Steadman, Chiara & Simpson

[57] ABSTRACT

A storage rack is provided with posts and shelving for supporting goods. The posts are of the type having keyhole slots. Several types of post protectors are disclosed. Both of the post protectors have fasteners engageable with the keyhole slots to provide means to secure them to a storage rack to minimize damage to the storage rack posts in the event that the posts are accidentally struck by various types of vehicles such as fork lift trucks and the like. The one post protector is provided for mounting on the front face of the post and extends vertically a number of feet to protect the storage rack post from ground level upwards to a desired point. A second corner post protector is provided for mounting at right angles to the other first described post protector and provides means to shield the post from blows which might be directed or received at generally right angles to those receivable against the other first described post protector.

13 Claims, 5 Drawing Figures

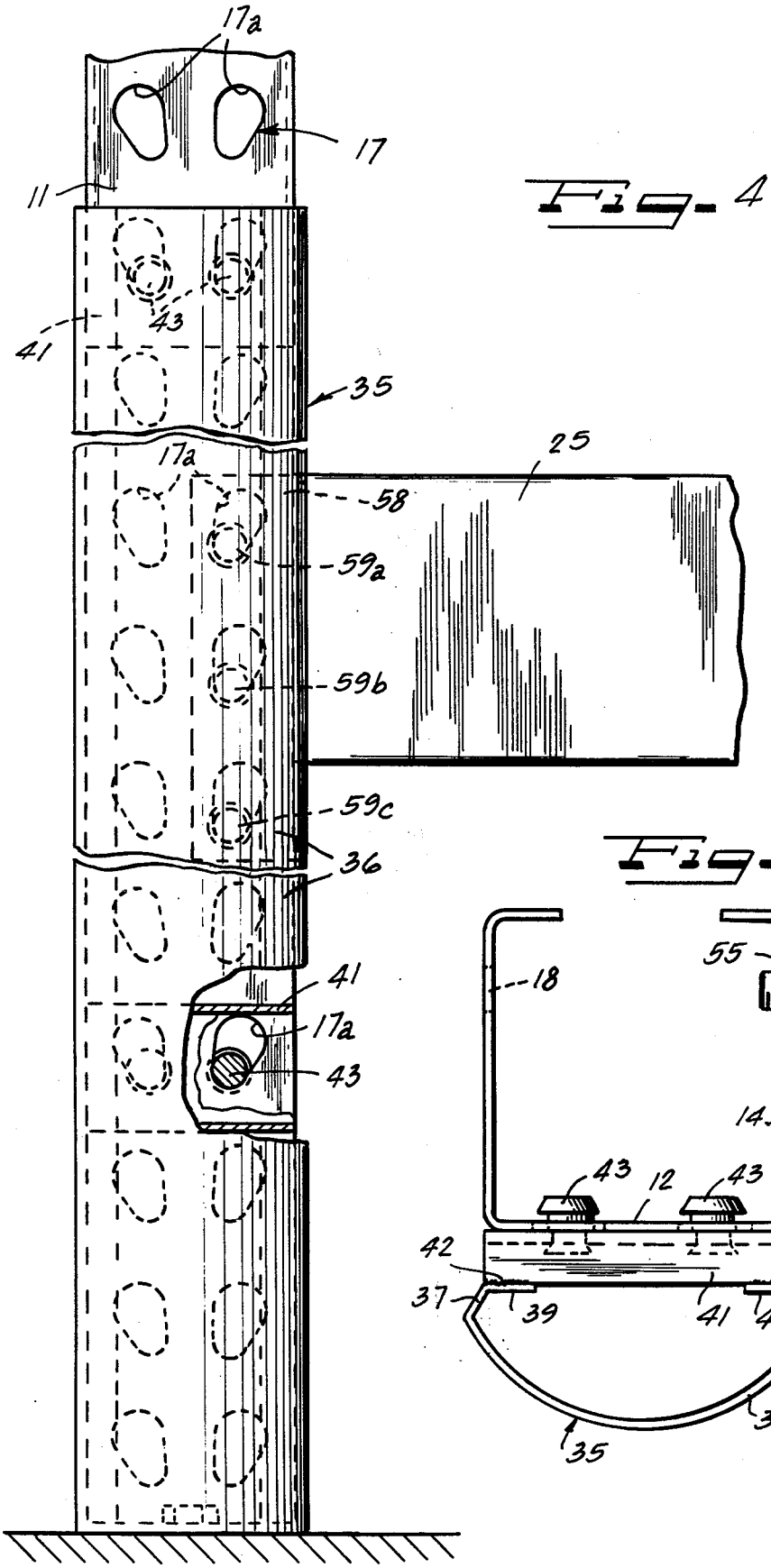
Fig. 4
Fig. 5
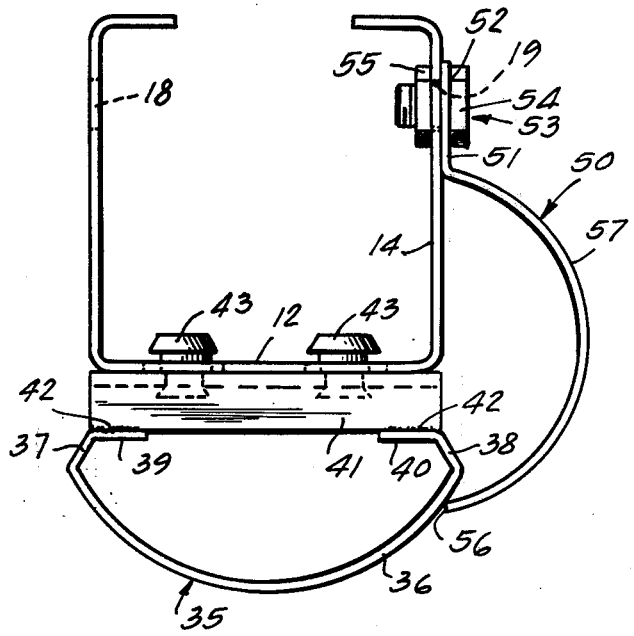

PALLET RACK AND POST PROTECTOR ASSEMBLY

BACKGROUND OF THE INVENTION

Field of the Invention

The present invention relates to a storage rack for industrial use and more particularly to attachments for the storage rack for the purpose of protecting the storage rack from damage from vehicles such as fork trucks and the like.

In industry, it has been found that with the widespread usage of fork trucks and other vehicles in industrial plants that there has been considerable damage experienced as a consequence of inexperienced or careless drivers of the vehicles. Where the vehicles come into contact with the storage rack, the posts can be bent out of shape and in some situations, depending upon the force of impact against the storage rack, the inventory stored on the racks can be caused to be spilled from the shelving carrying the same. The storage racks are expensive to replace and/or repair.

An important object of this invention is to provide post protectors having surfaces which, when contacted by a fork lift truck, will resist or deflect the impact, thus saving the post from damage.

According to one feature of this invention, the post protector is slightly larger in width than the post and arcuate in shape so that it will deflect a vehicle before the vehicle strikes the post. By providing a protector with a curved surface the blows directed against the post protector glance off.

According to other features of this invention, the new post protector can be mounted on a storage rack with one post protector being stacked vertically on top of another one and secured by attachment studs and keyhole slots on the storage rack posts.

According to other features of this invention, the post protector is particularly configurated so as to set forward of the storage rack post a sufficient distance so that should the post protector be subject to an impact force, it will resist damage to the post, since an adequate space is provided between the curved surface and the post itself.

According to other objects of this invention, a second new and improved corner post protector has been provided for co-action with the previously described corner protector so that angled margins of a post can both be protected from a fork lift truck and the like.

Other features of my invention concern a storage rack having a post with spaced keyhole slots on one margin and a second margin disposed at right angles to the first margin with the second margin having spaced holes. One post protector includes an arcuate intermediate section and opposed attachment sections at its opposite ends which attachment sections are disposed behind the intermediate section and means which are provided for joining attachment studs to the attachment sections and with the studs extended rearwardly in a direction away from said intermediate arcuate section and being engageable in said keyhole slots securing the post protector in assembly with the storage rack. The other post protector has an attachment leg and fasteners securing the attachment leg with the holes in the second margin of the post and with the corner post protector having an arcuate section having a radius extending at right angles to a radius of the arcuate section of the post protector and with the arcuate section of the corner post protector having its outermost edge disposed for sliding edgewise engagement with respect to an outer curved surface of the arcuate section of the post protector.

DESCRIPTION OF THE DRAWINGS

FIG. 4 is an enlarged fragmentary front elevation with parts broken away illustrating the manner of securement of the post protector to the storage rack; and FIG. 5 is an enlarged plane view of a rack post having a post protector and a corner post protector secured on opposite faces of the storage rack leg.

Figure 1:
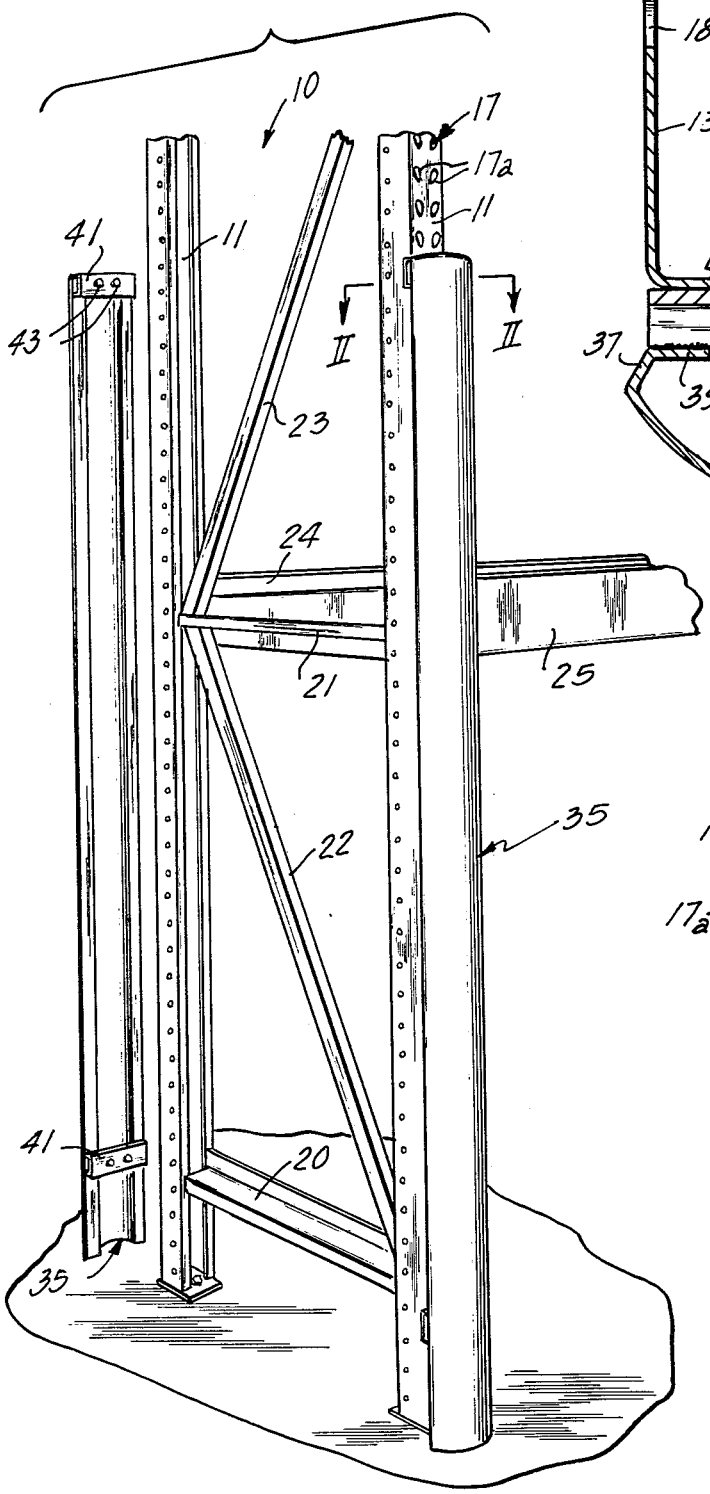
FIG. 1 is an enlarged fragmentary exploded view of a storage rack having post protectors embodying important features in my invention.

The reference numeral 10 indicates generally a sheet metal storage rack which is comprised of a number of different components and of a modular construction to enable the components to be arranged in different arrangements in accordance with the needs of the user. These components all can be detachably assembled and disassembled easily to facilitate adjustment of the components to fit the needs of the user.

The rack includes a pair of vertical posts (FIG. 1). The opposite end of the rack 10 is not shown but is intended to be identical to the end of the rack that is shown. Each of the posts 11 is comprised of a single piece of metal having an outwardly faced facing post section or margin 12, parallel side post sections or margins 13 and 14 and opposed terminal end sections 15 and 16. The outwardly facing post sections 12 each are provided with a row 17 of vertically spaced pairs of keyhole slots 17*a*—17*a*. The slots 17*a*—17*a* in each pair are angularly related to one another to allow a better fit for components being attached to the rack by means of studs. The parallel side post sections 13 and 14 are each provided with a pair of vertically spaced holes 18 and 19 (FIG. 2).

In accordance with the conventional practice in the industry, the posts 11—11 can be suitably secured together by a series of horizontal connecting lengths 20 and 21 and a series of truss legs 22 and 23 all as seen in FIG. 1. These components can be secured together in any suitable relation. The rack is further provided with a suitable number of vertically spaced horizontal rack beams 24 and 25 which each preferably are of a sheet metal construction and each have a ledge for supporting wooden planks or a sheet metal decking thereon, as shown in companion pending U.S. application for patent of Robert J. Evans, U.S. Ser. No. 634,433, now U.S. Pat. No. 4,048,059.

In accordance with the important features of my invention, a post protector 35 is illustrated in FIGS. 1–5 as being attached to a storage rack 10. The post protector 35 has an arcuate intermediate section 36, and inwardly angled post protector leg sections 37 and 38. The legs 37 and 38 terminate in inwardly extended opposed attachment sections 39 and 40. It will thus be seen from a consideration of FIG. 2 that the arcuate intermediate section 36 is spaced a substantial distance from the post margin 12 to provide an ample hollow area so that should the post protector become damaged by a fork lift truck and the like, the force of the blow would not necessarily cause damage to the associated post of the storage rack.

Figure 2:
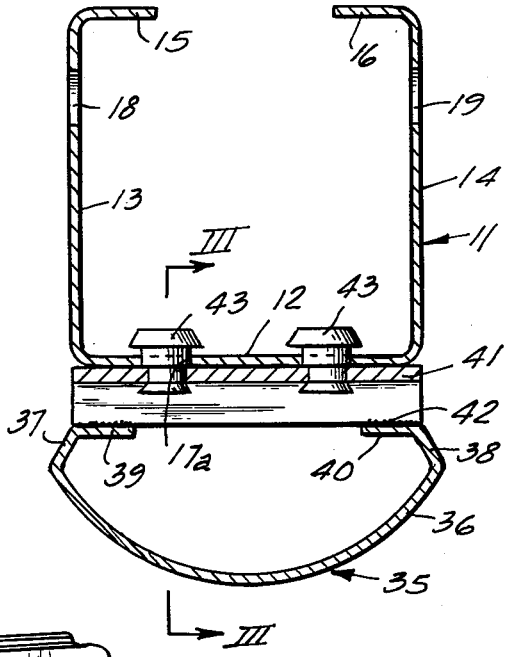
FIG. 2 is an enlarged cross-sectional view taken on the line II—II looking in the direction indicated by the arrows as shown in FIG. 1.
Figure 3:
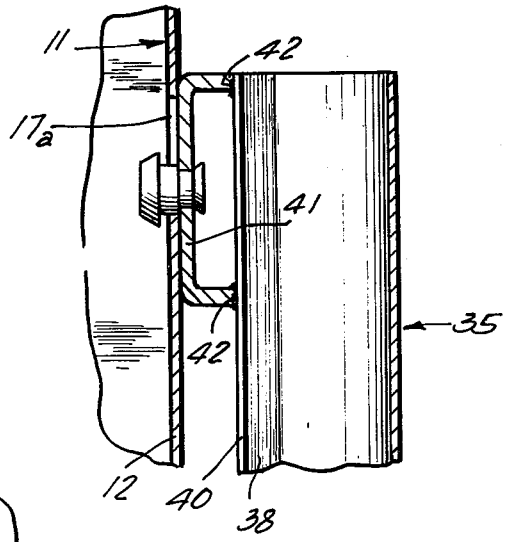
FIG. 3 is an enlarged cross-sectional view taken substantially on the line III—III looking in the direction indicated by the arrows as seen in FIG. 2.

As will be seen from FIGS. 1 and 2, a pair of attachment brackets or channels 41—41 are spot welded at 42 (FIG. 2) to the attachment flanges 39 and 40. A pair of attachment studs 43—43 are secured to each of the channels 41—41 which studs are attached to co-act with the keyhole slots 17*a*—17*a* in the securement of the post protector 35 to the rack post 11. These post protectors 35 can be attached to any margin of the storage rack posts where keyhole slots are provided for attachment. While other types of fasteners could be used for securing the post protector to the storage rack and since the keyhole slots are well suited for enabling other components of the rack to be mounted on the rack posts, it is preferred that studs and keyhole slots be used to secure the post protectors to the rack as here disclosed.

The attachment brackets 41—41 are preferably mounted at different distances from the respective ends of the post protector 35. As shown in FIG. 4, the beam 25 is typically mounted to the post 11 by use of a flange section 58 having studs 59*a, b, c* which co-act with slots 17*a*. If a beam 25 is to be attached to a post 11 at the same level as one of the attachment brackets 41 of a previously mounted post protector 35, interference between the beam flange section 58 and attachment brackets 41 can be avoided by rotating the protector 35 upside down. Since the brackets 41 are preferably mounted at different distances from the protector 35 ends, a conflict is thereby avoided.

The reference numeral 50 in FIG. 5 illustrates the second post protector which has been identified herein as a corner post protector. The corner post protector includes an attachment leg 51 with holes 52. These holes are adapted to be aligned with holes 19 in the side margin 14 of the post. Suitable fasteners 53 including a threaded stud bolt 54 and a nut 55 are provided for securing the corner post protector at spaced intervals to the post 11.

The corner post protector is further provided with an arcuate or extended section 57 having a smaller radius than the arcuate or extended section 36. The arcuate section 57 terminates in an outer edge 56 which is particularly adapted to engage and slide along an outer surface of the intermediate arcuate section 36 on the post protector 35.

SUMMARY

The purpose of the post protectors is to have any blows glance off when delivered against the post protectors when assembled to a storage rack and how we put it on the upright is incidental. Up to now, industry has anchored angle irons in concrete on the floor and have used all kinds of expensive ways of protecting racks. The assignee has also provided a short post protector of a type where the lower end of the post is telescoped into the tubular post protector. This post protector is anchored by bolts to a floor.

The new post protector 35 here disclosed can be of any height such as 6ft. high. One can be stacked on top of another if the rack is of such height to need more than one. This is an important feature that one section can be put on top of another quickly. The same stud is used in the shelf connector and also used on the back of this item, so it hooks onto the post. Also the fastening device at each end of the protector can be located at different locations than the ends. The fastener devices are made so that wherever the beam is located on the post the protector can be reversed so the post protector fastening device does not interfere with the installation of a beam 25 at any level. It will be recognized that if the post protecor was in place with the fastening device then a beam 25 could not be at the same level.

The post protector 35 sets forward of the post decidedly so it can become bent and still not damage the post. The extra space is important.

I claim as my invention:

1. In combination, a storage rack having a post with spaced keyhole slots on one margin and a second margin disposed at right angles to the first margin with said second margin having spaced holes, a post protector including an arcuate intermediate section and opposed attachment sections at its opposite ends which attachment sections are disposed behind the intermediate section, means joining attachment studs to said attachment sections and with said studs extended rearwardly in a direction away from said intermediate arcuate section and being engageable in said keyhole slots securing the post protector in assembly with the storage rack, and a corner post protector having an attachment leg and fasteners securing said attachment leg with the holes in said second margin of said post and with said corner post protector having an arcuate section having a radius extending at right angles to a radius of said arcuate section of said post protector and with the arcuate section of said corner post protector having its outermost edge disposed for sliding edgewise engagement with respect to an outer curved surface of the arcuate section of the post protector.

2. The combination of claim 1 further characterized by the arcuate section on the corner post protector having a smaller radius than the arcuate intermediate section or said post protector.

3. A sheet metal post protector for attachment to a storage rack comprising an arcuate intermediate section having its opposite ends inwardly extended providing opposed attachment sections lying generally in a common plane and spacer plates secured to said attachment sections at nonuniform intervals and projecting rearwardly in a direction opposite to the direction of an arc of the arcuate section, and attachment studs secured to said spacer plates for attachment of the post protector to a storage rack, the post protector being rotatable 180° so as to be attachable in an upright position and also in an upside down position to allow said spacer plates to clear an interfering rack beam should interference occur.

4. The post protector of claim 3 further characterized by said spacer plates each being channel shaped and being in welded assembly with said attachment sections.

5. In combination, a storage rack having a post with spaced keyhole slots on one margin and a second margin disposed at right angles to the first margin with said second margin having spaced holes, and a corner post protector having an attachment leg and fasteners securing said attachment leg and the corner post protector with the holes in said second margin of said post and with said corner post protector having an arcuate section projected forwardly of said attachment leg and with the arcuate section having a forwardmost edge positioned beyond said one margin and forwardly of the key hole slots on said one margin, a post protector including an arcuate section, attachment studs secured to said post protector at one end and with said studs providing means engageable in said keyhole slots on said one margin for securing the post protector in assembly with the post, said forwardmost edge of said corner post protector positioned for edgewise sliding engagement with an outer curved surface of said arcuate section of said post protector.

6. The combination of claim 5 further characterized by the arcuate section on the corner post protector having a smaller radius than the arcuate intermediate section or said post protector.

7. In combination, a storage rack having a post with spaced keyhole slots on one margin and a second margin disposed at right angles to the first margin with said second margin having spaced holes, a post protector including an intermediate section and opposed attachment sections at its opposite ends which attachment sections are disposed behind the intermediate section, means joining attachment studs to said attachment sections and with said studs extended rearwardly in a direction away from said intermediate section and being engageable in said keyhole slots securing the post protector in assembly with the storage rack, and a corner post protector having an attachment leg and fasteners securing said attachment leg with the holes in said second margin of said post and with said corner post protector having an extended section and with the extended section of said corner post protector having its outermost edge disposed for sliding edgewise engagement with respect to an outer surface of the intermediate section of the post protector.

8. In combination, a storage rack having a post with spaced keyhole slots on its margin, a post protector including an arcuate hollow intermediate section having a width when measured transversely between its opposite edges thereof which exceeds the width of said one margin of said post to protect said post, and means joining attachment studs to said post protector and with said studs extended rearwardly in a direction away from intermediate hollow arcuate section and being engageable in said keyhole slots securing the post protector in assembly with the storage rack, a corner post protector having an attachment leg, a fastener securing said attachment leg and the corner post protector with slots in a second margin of said post with said corner post protector having an arcuate section projecting forwardly of said attachment leg and with the arcuate section having a forwardmost lead edge positioned so as to be engageable with an outer surface of said arcuate hollow intermediate section and with said lead edge being slidably engaged along said arcuate hollow intermediate section when an impact is directed against said corner post protector whereby said arcuate section on said corner post protector operates as a resilient spring.

9. In combination, a storage rack having a post with spaced keyhole slots on one margin, and at least one beam having studs securing the beam in the keyhole slots on the post, a sheet metal post protector for attachment to said post and comprising a generally channel-shaped intermediate section having its opposite ends inwardly extended providing opposed attachment sections lying generally in a common plane, spacer plates extending rearwardly of said channel-shaped intermediate section and secured in assembly with said attachment section, the spacer plates having a thickness exceeding the thickness of said beam so as to provide a vertical slot between the post and the post protector of a sufficient size to allow said beam to be positioned in assembled relation with the post between the post protector and the post, and attachment studs secured to said spacer plates for attachment of the post protector to said post.

10. The combination of claim 9 further characterized by said post protector having inclined sections joined with said intermediate section at its opposite edges.

11. The combination of claim 10 further characterized by said inclined sections each being joined at one end with said intermediate section and with an attachment section supporting said studs at its opposite end.

12. The combination of claim 9 further characterized by said storage rack having its horizontal beams carrying a decking for supporting inventory with said beams being joined with said post, said attachment studs mounted on said post protector being disposed in positions out of horizontal alignment with respect to said beams and the points of attachment of said beams with said post.

13. The post protector of claim 9 further characterized by said attachment sections being secured to said channel-shaped intermediate section at nonuniform intervals enabling the post protector to be rotatable 180° so as to be attachable in an upright position and also in an upside-down position to allow such spacer-plates to clear said rack beam should an interference occur between the rack beam and the spacer plates.

* * * * *